US006637510B2

(12) United States Patent
Lee

(10) Patent No.: US 6,637,510 B2
(45) Date of Patent: Oct. 28, 2003

(54) WELLBORE MECHANISM FOR LIQUID AND GAS DISCHARGE

(76) Inventor: Dan Lee, 1007-55th Avenue N.E., Calgary (CA), T2E 6W1

( * ) Notice: Subject to any disclaimer, the term of this patent is extended or adjusted under 35 U.S.C. 154(b) by 0 days.

(21) Appl. No.: 10/013,030

(22) Filed: Nov. 12, 2001

(65) Prior Publication Data

US 2003/0034158 A1 Feb. 20, 2003

(30) Foreign Application Priority Data

Aug. 17, 2001 (CA) ..... 2355500

(51) Int. Cl.[7] ..... E21B 43/00; F02B 47/12

(52) U.S. Cl. ..... 166/108; 166/105; 166/372; 417/57; 417/56

(58) Field of Search ..... 166/105, 372, 166/108; 417/56, 57, 60

(56) References Cited

U.S. PATENT DOCUMENTS

| | | | | |
|---|---|---|---|---|
| 3,968,839 A | | 7/1976 | Swihart, Sr. | |
| 4,275,790 A | | 6/1981 | Abercrombie | |
| 4,502,843 A | | 3/1985 | Martin | |
| 4,629,004 A | | 12/1986 | Griffin | |
| 4,712,981 A | * | 12/1987 | Gramling | 417/56 |
| 4,781,547 A | * | 11/1988 | Madden | 417/444 |
| 4,889,473 A | * | 12/1989 | Krueger | 417/56 |
| 4,986,727 A | * | 1/1991 | Blanton | 417/57 |
| 5,127,803 A | * | 7/1992 | Walter | 417/57 |
| 5,333,684 A | * | 8/1994 | Walter et al. | 166/54 |
| 5,868,554 A | | 2/1999 | Giacomino et al. | |
| 6,148,923 A | | 11/2000 | Casey | |
| 6,176,309 B1 | * | 1/2001 | Bender | 166/68 |
| 6,200,103 B1 | | 3/2001 | Bender | |
| 6,209,637 B1 | * | 4/2001 | Wells | 166/153 |

* cited by examiner

*Primary Examiner*—David Bagnell
*Assistant Examiner*—Thomas Bomar
(74) *Attorney, Agent, or Firm*—McKee, Voorhees & Sease, P.L.C.

(57) ABSTRACT

A wellbore pump comprises a plunger having a passage which may be open or closed by a valve operated by a piston which is biased in the open position by a spring of selected strength such that the wellbore pressure may overcome the spring to close the valve when the accumulated hydrostatic pressure reaches a certain value. When the valve closes the reservoir pressure forces the plunger to the surface and causes the accumulated liquids to be pumped out of the wellbore.

3 Claims, 7 Drawing Sheets

WELLBORE MECHANISM FOR LIQUID AND GAS DISCHARGE

FIELD OF THE INVENTION

This invention relates to apparatus for the improved production of oil and natural gas wells. In particular, it relates to a mechanism which will automatically discharge accumulated liquids from the wellbore, without external Force or energy.

BACKGROUND OF THE INVENTION

Natural gas wells, unlike some oil wells, because of gases light weight and the capacity to expand when pressure is relieved, are able to flow naturally as a result of reservoir pressure without the need to be pumped as is the case in low pressure oil wells.

This phenomena is, however, subject to the exception that associated fluids in the nature of liquid such as water, oil, or petroleum condensates, tend to accumulate in the wellbore and when they reach a certain volume or hydrostatic head in the wellbore create a back pressure which is enough to diminish the flow of natural gas or stop it all together.

The solution, of course, is to periodically pump the liquids out of the wellbore when they restrict the flow.

One way to accomplish this is to insert a pumping or swabbing device through an entry chamber known as a lubricator and lower the device to the bottom of the well where by means of rods or cables the pump can be operated to pull liquids up to the surface where the liquids are caused to flow off through the same production line as the natural gas and are then separated. Once the accumulated heavy liquids are removed, the natural rate of gas flow resumes until more liquids eventually accumulate.

The foregoing method, however, involves workers' time and attention at periodic intervals and the use of pumping equipment which in the case of the well under pressure can be complicated, as well as dangerous.

It is therefore the purpose of this invention to provide a means for removing accumulated liquids from oil or natural gas wells (a process generally referred to as swabbing) by means of apparatus which is simple and relatively inexpensive. It is also the purpose of this invention to provide a mechanism which will function automatically without the attention and intervention of workers.

It is also the purpose of this invention to provide apparatus which will operate under the forces provided by the pressure of the gas reservoir without requiring externally applied forces or energy to operate the pump.

SUMMARY OF THE INVENTION

The wellbore pump mechanism of this invention has a plunger having a body of generally cylindrical proportions with an external cross-section smaller than the internal diameter of the wellbore and a series of seals extending from the outer surface of the plunger to form a fluid seal against the inner wall of the wellbore. The plunger has passage means to allow fluids to pass therethrough and a valve mounted within the body of said plunger which is biased in the open position whereby to allow fluids to travel through said valve, past said plunger, in an upward vertical direction through the wellbore. The valve is biased in the open position by a piston and a spring mechanism of selected strength and force, the spring being held in cylinder chamber isolated by the piston sealed against the inner diameter of said cylinder. The spring is selected such that its force is overcome by a selected hydrostatic pressure acting on the opposite side of the piston which is achieved when fluids in the well reach a certain hydrostatic head. When the valve is closed it prevents further flow through the plunger causing the reservoir pressure to build up beneath the plunger and forcing it to the surface and causing the liquid in front of it to be pumped to the surface and out of the well.

DESCRIPTION OF THE EMBODIMENT

Figure 1:
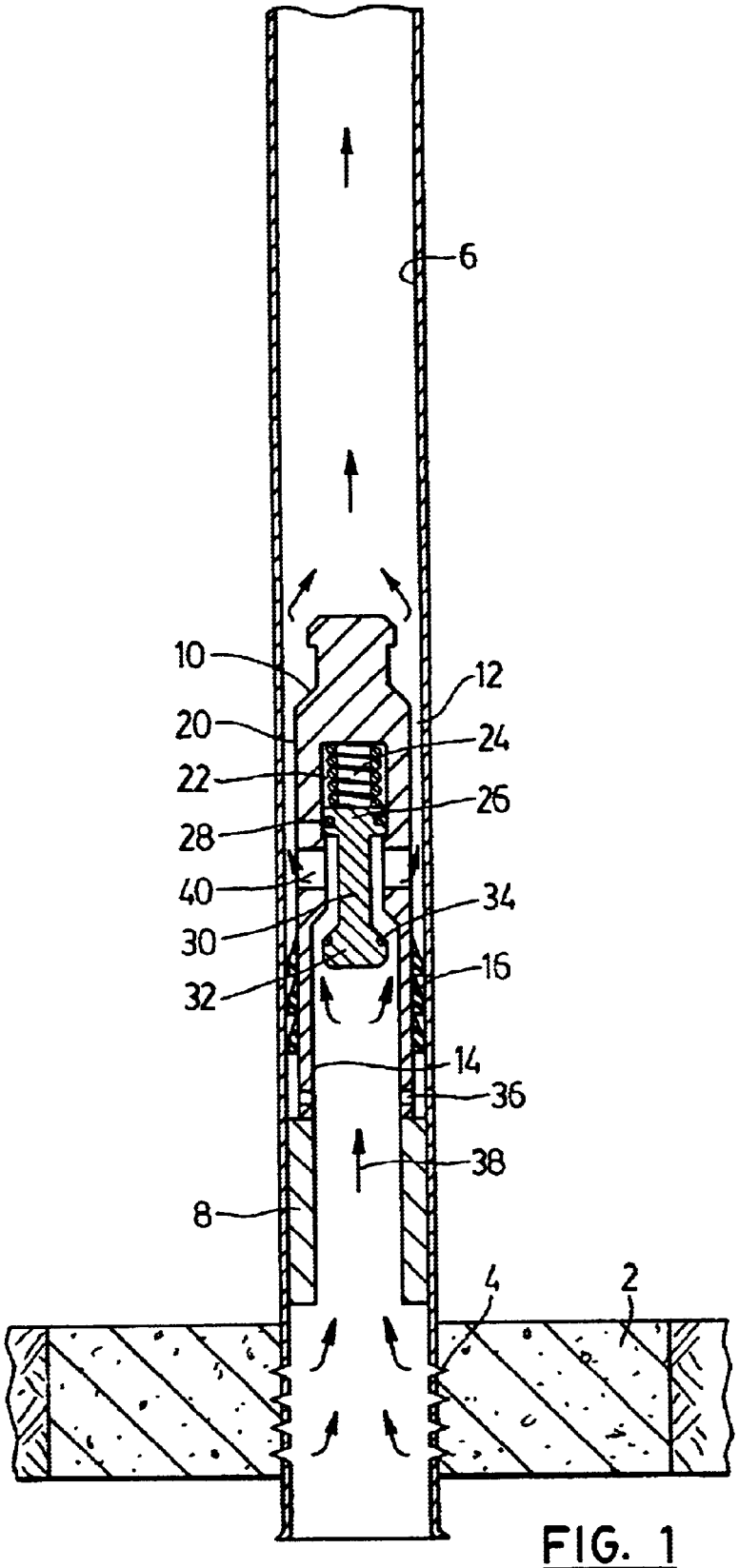
FIG. 1 is a vertical cross-section of a wellbore containing a pump mechanism of the present invention in the open position with production flowing.

In the illustrated embodiment of FIG. 1 a natural gas reservoir 2 is producing natural gas through perforations 4 into the wellbore 6 which is a string of hollow pipe extending to the well head at the surface.

Above the reservoir formation is a collar 8 mounted in the wellbore at a fixed location and presenting a hollow centre with a reduced diameter.

Resting on top of the collar is a plunger 10 of the elongated generally cylindrical configuration of smaller diameter than the wellbore so as to provide an annular gap or space 12 between the plunger and the internal surface of the wellbore.

The plunger has a lower end 14 with a substantially lower core and having seals 16 mounted on the outer surface thereof capable of forming a seal between the plunger and the inner surface of the wellbore.

The upper end of the plunger 20 has a cylinder chamber 22 housing a spring 24 which extends between the end of the chamber and the chamber end of the piston 26.

The piston 26 is sealed at 28 against the inner wall of the chamber and the piston arm 30 extends downwardly into the hollow opening of the lower portion 14 of the plunger and is attached at its lower end to a valve 32 having a seal mounted on the shoulder thereof at 34.

Hole 36 assures that the pressure of the producing wells is exposed to the plunger at the underside of the seals across the whole diameter of the wellbore.

It will be seen from the arrows 38 that natural gas produced from the reservoir through the perforations travels upwards through the collar 8 through the lower end of the plunger 14, through the valve and out of the plunger through the ports 40 into the annular area 12 and onwards and upwards past the plunger to rise through the wellbore to the surface where it is directed away from the well head by production lines to a collection or separation or refinery facility.

Figure 2:
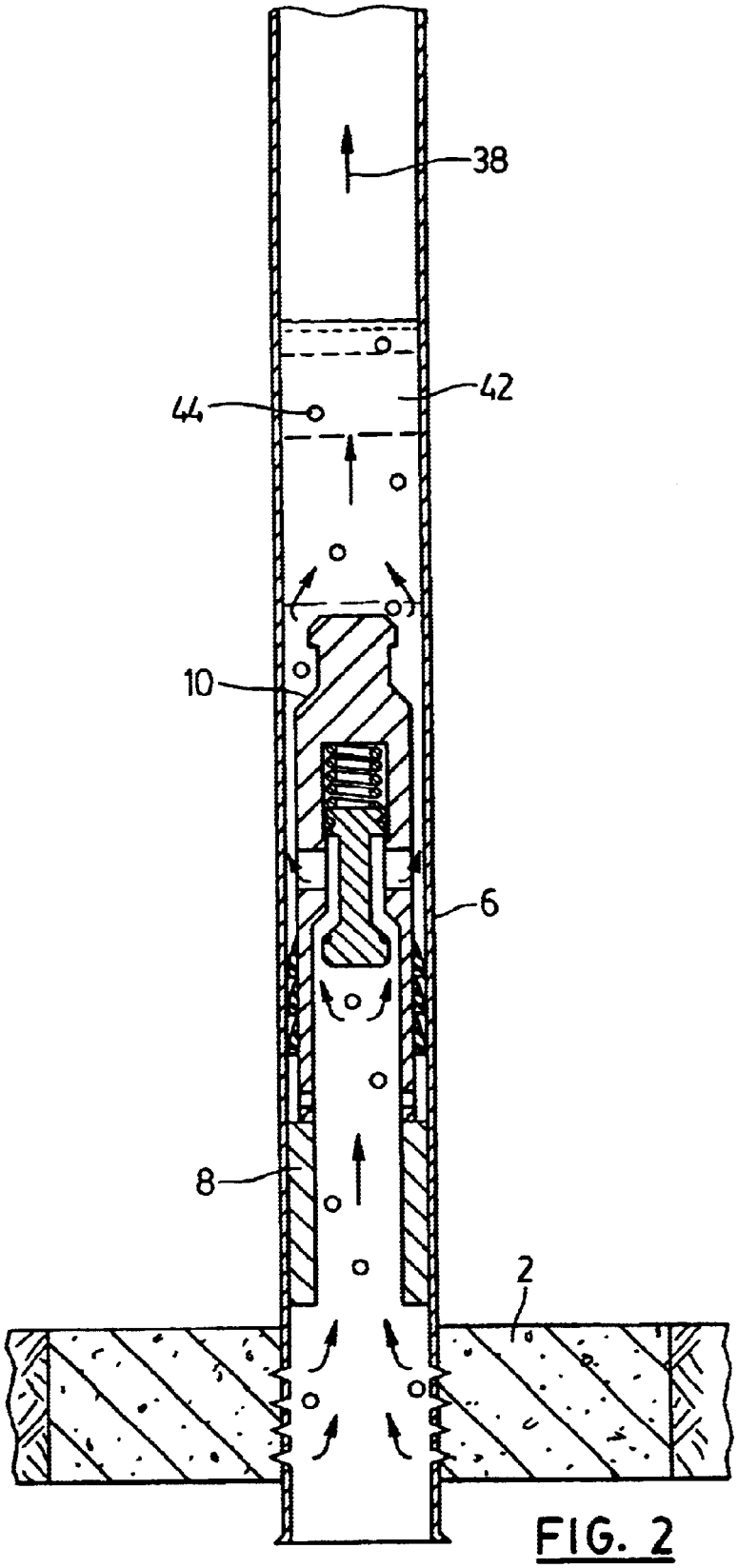
FIG. 2 is vertical cross-section similar to FIG. 1 showing the accumulation of heavy liquids.

However, as illustrated in FIG. 2, the production of natural gas is frequently associated with some amounts of water (especially in wells reaching the end of their life) or oil which is accumulated with gas, or condensate which is a form of hydrocarbon which is carried by the gas stream but separates as a liquid in the wellbore. These liquids being heavier than the natural gas accumulate in the bottom of the wellbore as illustrated at 42 in FIG. 2 with gas bubbles 44 rising through the liquid to the top of the well.

As can be seen in FIG. 2, the flow of fluids follows a similar path described above and illustrated in FIG. 1. However, it will of course be realized that under certain conditions, especially older wells where the reservoir pressure is being depleted, a column of water and/or oil and/or condensate will eventually create a back pressure which will restrict or stop the flow of fluids from the reservoir and the liquids must be removed in order to maintain production.

Figure 3:
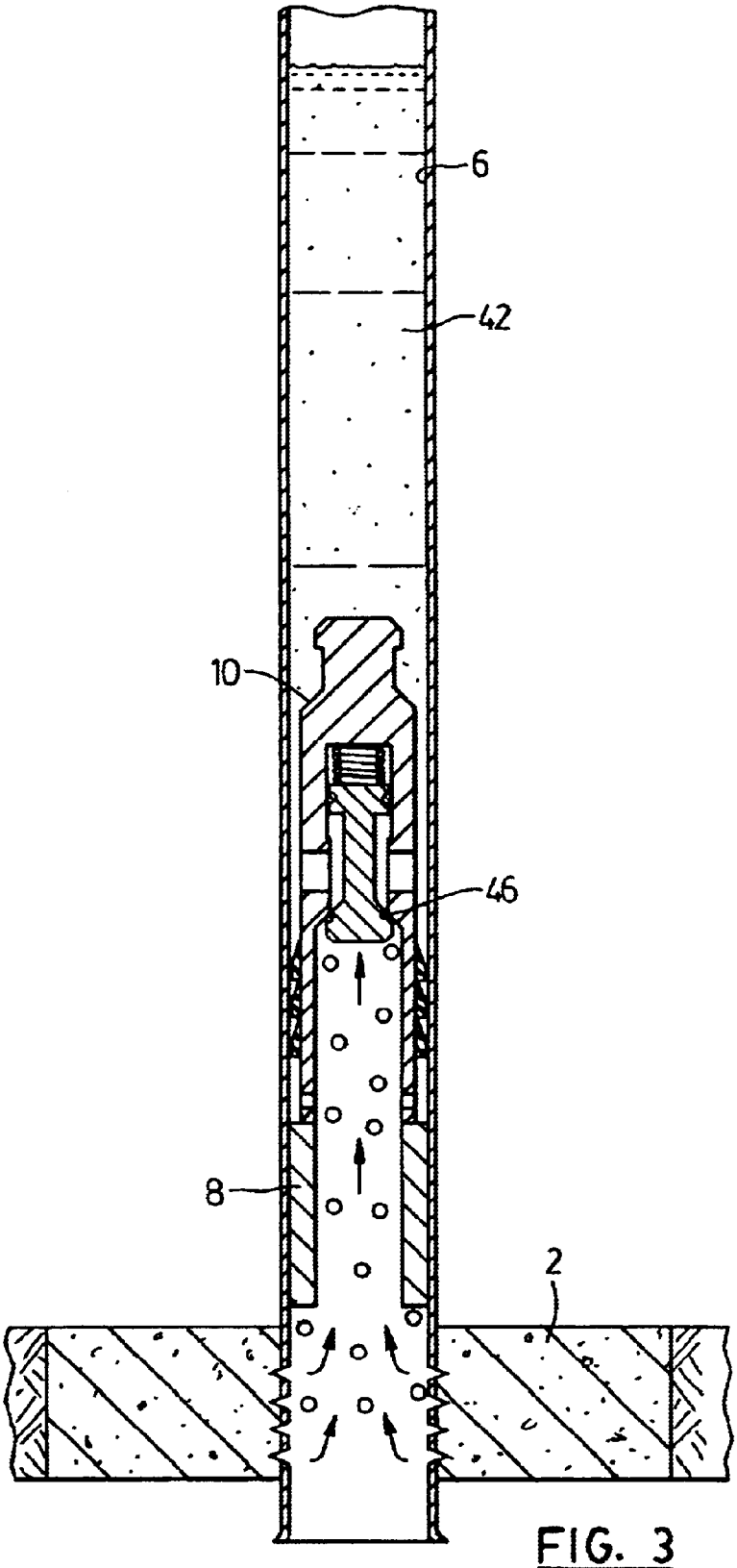
FIG. 3 is a cross-section similar to FIG. 2 showing the valve in the closed position.
Figure 4:
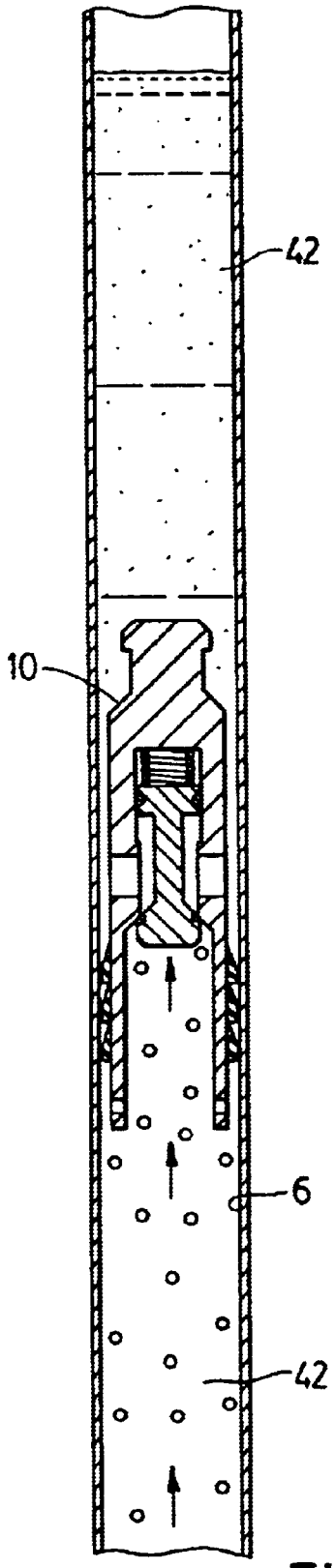
FIG. 4 is a vertical cross-section similar to FIG. 3 showing the plunger rising to the surface pushing fluids ahead of it.

As illustrated in FIG. 3, when the hydrostatic head of liquids reaches a certain value, the hydrostatic pressure generated thereby will remain less than the formation pressure for a period of time and the formation continues to produce until pressure builds up below the valve 32 and the piston 26. At a certain point the pressure on this piston rises until it is sufficient to overcome the strength of the spring and compress it causing the valve 32 to close by means of the seal 34 against the shoulder 46 of the plunger. This precludes any further flow through the ports 40 and results in a build up of pressure below the seals 16 so that eventually the reservoir pressure forces the plunger 10 to rise off the collar 8 and move vertically upwards in the wellbore driving the column of fluids 42 ahead of it as illustrated in FIG. 4.

Figure 5:
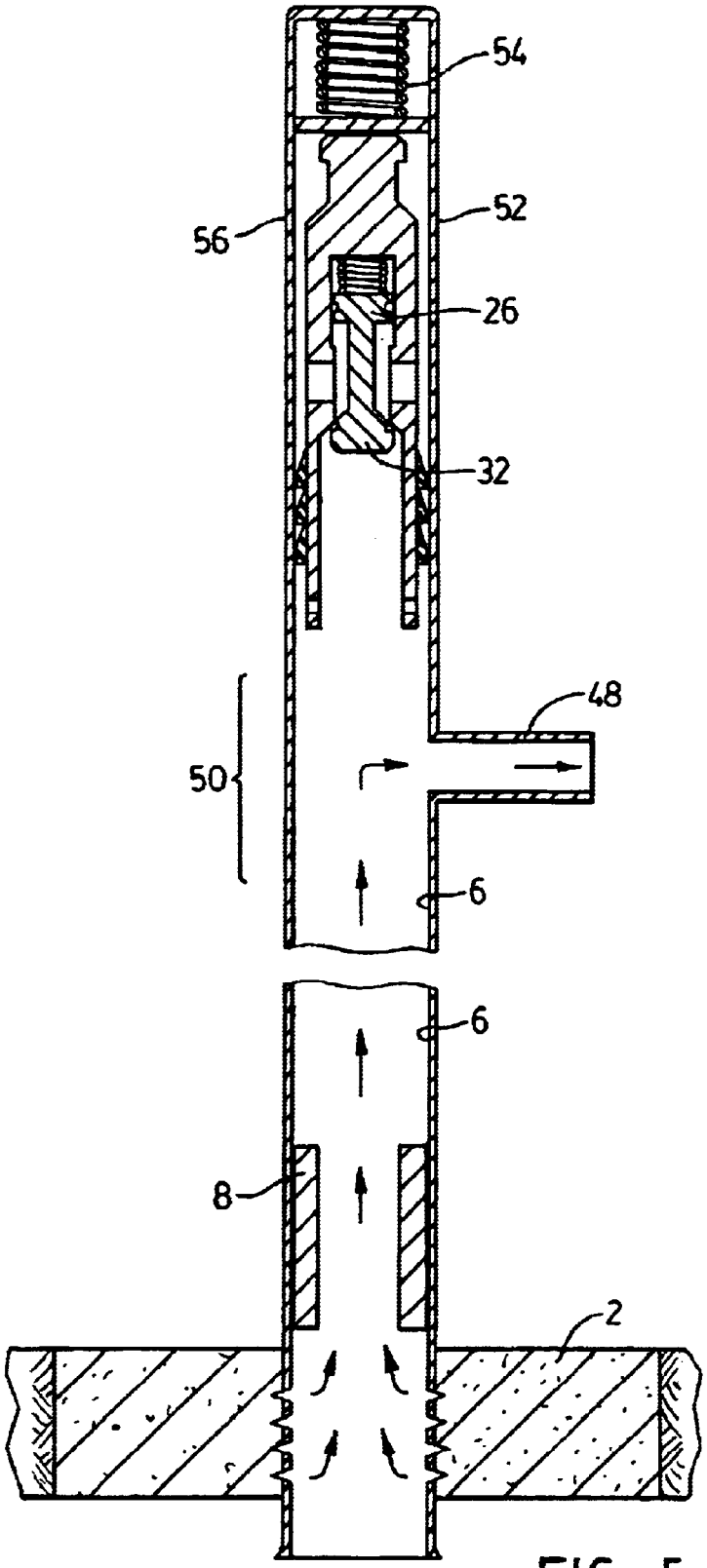
FIG. 5 is a vertical cross-section of the well showing the plunger at the surface after having swabbed the liquids out of the well.

Thus, at the appropriate time, when the back pressure from the accumulated liquids has caused enough pressure to collapse the spring 24, the valve will close and the plunger will automatically pump the accumulated liquids to the surface thereby conducting the swabbing operation automatically at intermittent intervals. The operation at the well head is illustrated in a simplified fashion in FIG. 5. At the top of the wellbore 6 a flow line 48 carries off the produced natural gas as well as the associated water, oil, or condensate forced to the top by the plunger and all fluids are taken to a facility where they are appropriately separated and/or treated.

Above the well head shown schematically at 50, is a chamber 52 within the casing 56 of wellbore 6 (known as a lubricator) which is long enough to receive the plunger at a location out of the path of flow of the well fluids.

Ideally, a shock absorber comprising a spring or similar device such as shown at 54 will cushion the impact of the plunger when its hits the top of the well head.

Figure 6:
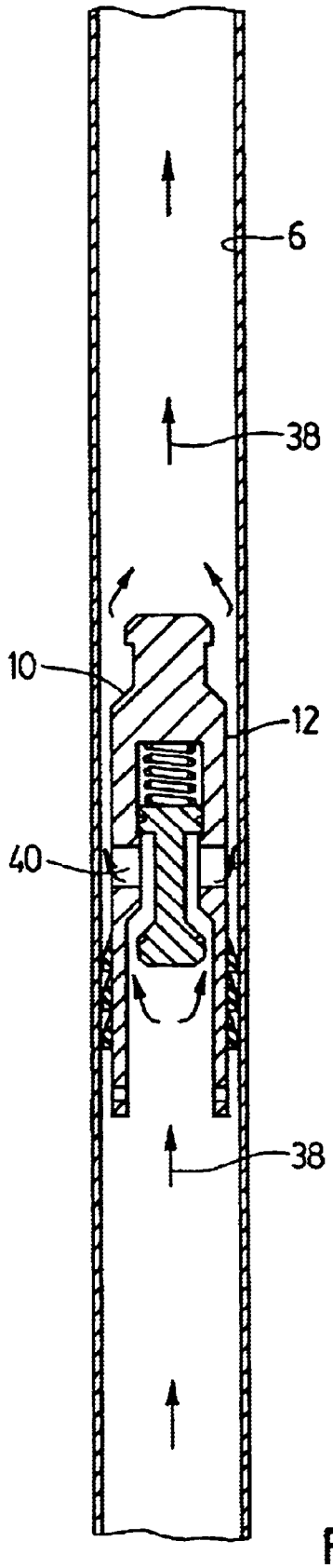
FIG. 6 is a vertical cross-section of the well showing the plunger returning to the bottom of the well.

In this position the liquids having been removed from the production stream, the well will begin to flow at a normal rate and the pressure in the wellbore will drop as a result of the resistance in the reservoir. When the pressure on the piston 26 drops sufficiently the spring will overcome it and the piston will lower thus releasing the valve 32 in the lower section of the plunger. Once the valve has opened the plunger may fall down the well because fluids travelling up the wellbore are permitted to pass through the valve out through the ports 40 through the annular area 12 and up through the top of the wellbore. At the same time the plunger is allowed to fall by its own weight counter to the production flow as illustrated in FIG. 6 and eventually will come to rest on the collar 8 at the bottom of the wellbore as seen in FIG. 1.

In this position the well will continue to produce natural gas until the associated accumulation of water, oil or condensate reaches the critical back pressure necessary to close the valve again and start the swabbing cycle all over again.

Figure 7:
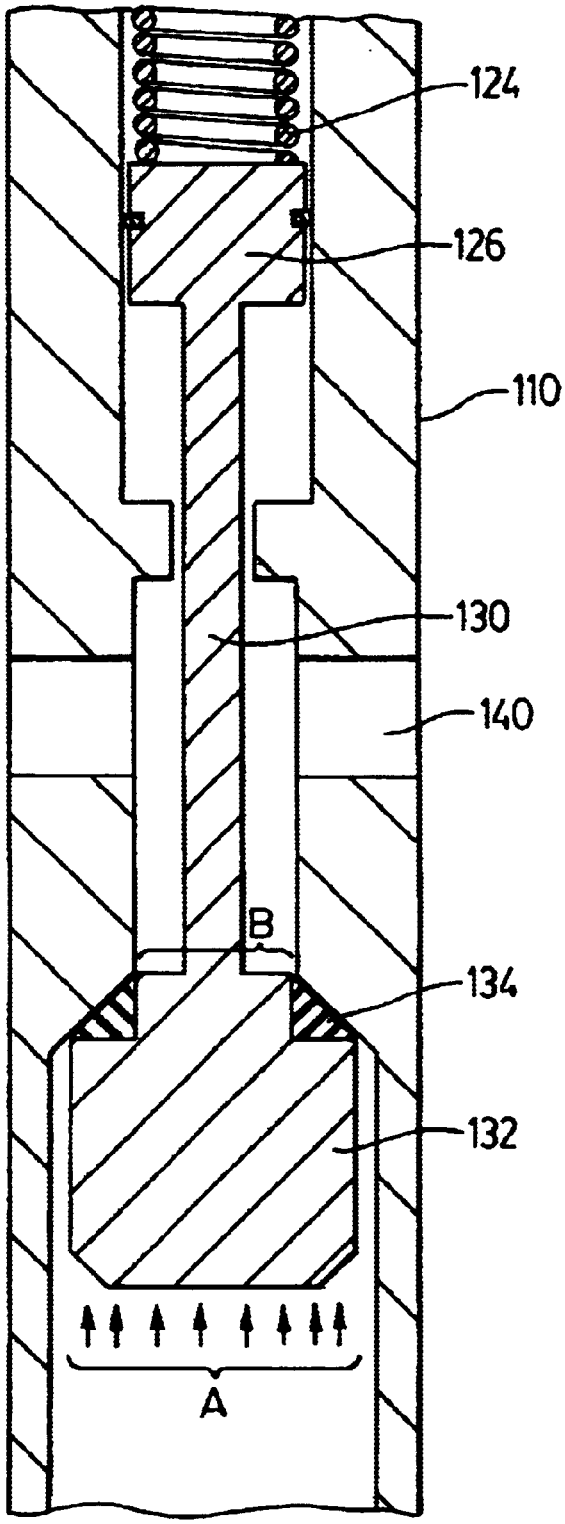
FIG. 7 is a second embodiment of the plunger in which the valve operates by differential pressure on the piston.

FIG. 7 represents a modified embodiment of the invention in order to respond more effectively to selected pressure points.

In this embodiment the plunger 110 has similar ports 140 and a spring chamber 124 with a piston 126 and an arm 130.

However, in this embodiment the valve 132 has an enlarged shoulder with a seal 134 so that the wellbore pressure acting on the closed valve over area A has a greater force than the pressure above the valve acting on the smaller cross-sectional area B.

Therefore, once the valve closes to the position shown in FIG. 7, the force due to wellbore pressure forcing on the valve into the closed position will remain larger than the force tending to open it so that the valve does not immediately open as soon as the pressure drops below the selected pressure point to activate the plunger. The areas may be designed so that the valve will not reopen until the pressure acting on area A has dropped by a predetermined value such as 30 or 40 or 50 psi.

By virtue of this arrangement the valve will tend to stay closed until the swabbing action is completed and will not tend to open and close irradically when pressures vary slight above or below the trigger point during the operation of the device.

It will, of course, be realized that numerous other modifications and variations may be employed without departing from the inventive concept herein.

What is claimed is:

1. A wellbore mechanism for effecting liquid and gas discharge from a wellbore having an inner wellbore wall, the wellbore having liquid and gas therein, the mechanism comprising:

a plunger of generally cylindrical proportion adapted to fit within the wellbore;

a plunger seal on the outside of the plunger and being in sealing engagement with the wellbore wall to provide a seal therebetween;

a passage extending through the plunger to allow the liquid and gas in the wellbore to pass through the plunger;

a valve in the passage movable between an open position and a closed position;

a cylinder within the plunger having a closed cylinder end and a cylinder wall forming a cylinder bore extending away from the closed cylinder end inside the cylinder;

a piston within the cylinder bore and having an interior piston surface facing toward the closed cylinder end to form a cylinder chamber between the piston and the closed cylinder end, the piston having an exterior piston surface facing away from the cylinder chamber;

the piston being connected to the valve and being movable within the cylinder bore between a first piston position holding the valve in the open position and a second piston position holding the valve in the closed position;

a spring within the cylinder chamber engaging the interior surface of the piston to bias the piston toward the first piston position;

the cylinder exposing the exterior surface of the piston to hydrostatic pressure from the liquid within the passageway and preventing exposure of the interior surface of the piston to the hydrostatic pressure from the liquid within the passageway, whereby when the hydrostatic pressure on the exterior surface of the piston exceeds the bias of the spring, the piston will move to the second position, thereby causing the valve to move to the closed position.

2. The wellbore mechanism of claim 1 and further comprising a piston seal on the piston between the interior and exterior surfaces of the piston and engaging the cylinder wall to effect a seal between the piston and the cylinder wall throughout movement of the piston between the first and second positions within the cylinder and thereby isolate the cylinder chamber from hydrostatic pressure of the liquid within the passageway.

3. The wellbore mechanism as set forth in claims 1 or 2 wherein the valve includes a first valve surface presented toward the cylinder chamber and a second valve surface facing away from the cylinder chamber, the first valve surface being smaller than the second valve surface whereby the hydrostatic pressure on the second valve surface will exceed the hydrostatic pressure on the first valve surface to create a net force urging the valve to the closed position against the bias of the spring.

* * * * *